United States Patent [19]

Pellin

[11] 4,102,654

[45] Jul. 25, 1978

[54] NEGATIVE IONIZER

[75] Inventor: Henri Maurice Pellin, Grenoble, France

[73] Assignee: Raymond Bommer, La Forteresse, France

[21] Appl. No.: 819,117

[22] Filed: Jul. 26, 1977

[30] Foreign Application Priority Data

Jul. 27, 1976 [FR] France ..... 76 22831

[51] Int. Cl.[2] ..... B03C 3/38

[52] U.S. Cl. ..... 55/102; 55/126; 55/138; 55/150; 55/279; 21/74 R; 21/102 R; 250/432 R

[58] Field of Search ..... 21/74 R, 74 A, 102 R; 55/102, 138, 279, 126, 150; 250/432 R

[56] References Cited

U.S. PATENT DOCUMENTS

| | | | |
|---|---|---|---|
| 1,091,221 | 3/1914 | Helbronner et al. | 250/432 |
| 2,732,501 | 1/1956 | Blaeker | 21/74 R |
| 3,745,750 | 7/1973 | Arff | 55/124 |
| 3,910,778 | 10/1975 | Shahgholi et al. | 21/74 R |

FOREIGN PATENT DOCUMENTS

| | | | |
|---|---|---|---|
| 2,240,021 | 11/1975 | France | 21/74 A |
| 1,261,295 | 2/1968 | Fed. Rep. of Germany | 55/126 |

*Primary Examiner*—Bernard Nozick
*Attorney, Agent, or Firm*—Brisebois & Kruger

[57] ABSTRACT

A negative ionizer comprises an active filter, means to create a forced flow of air, a grid which is raised to a high positive potential to trap harmful negative ions, means for generating negative ions and a grid which is raised to a high negative potential to trap positive ions. The means for generating negative ions comprises a venturi made of polished metal and which is raised to a high negative potential and a germicidal tube for generating shortwave ultraviolet radiation disposed coaxially within the venturi.

6 Claims, 1 Drawing Figure

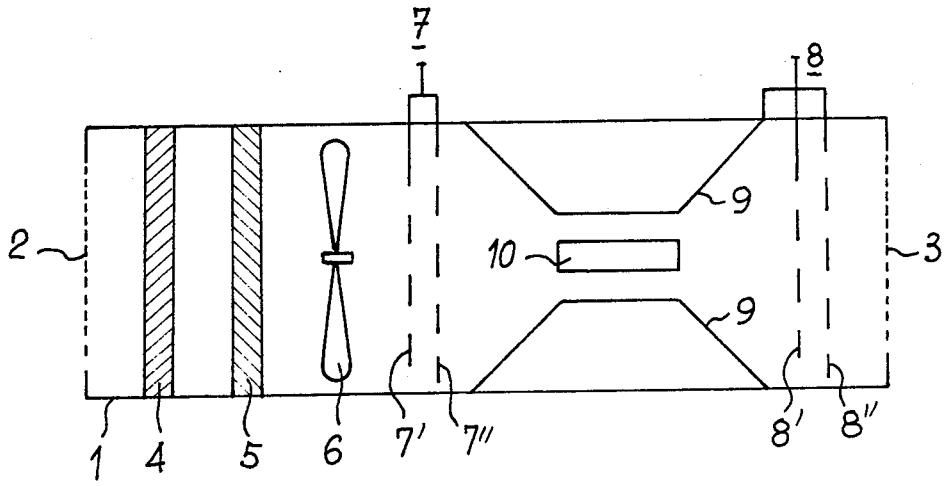
7
8
2
3
9
10
9
1
4
5
6
7'
7''
8'
8''

NEGATIVE IONIZER

The present invention relates to an improved negative ioniser, that is to say a device which produces negative ions in air.

BACKGROUND OF THE INVENTION

Various negative ionisers have been proposed hitherto, without however giving satisfaction as regards the quality of the air which is breathed from day to day; particularly in the case of localities of small volume, such as aircraft, motor vehicles, sick rooms, dwellings, offices etc.

One of the serious disadvantages of known negative ionisers is that the volume of ambient air which they enrich with negative ions is only a small volume surrounding the said ioniser.

In certain cases a flow of air is set up so that when the air arrives at the ioniser which is to produce a negative charge in this moving air, it is travelling at a certain speed. Another disadvantage then becomes apparent, due to the fact that the air which is directed onto the ioniser is generally polluted air and consequently the device which is used will ionise both the air and also the particles of pollution. Since the ionisation is negative, these particles of pollution, which are generally large particles, will then be breathed in through the respiratory passages and will collect at the bottom of the pulmonary alveoli, being repelled by the inner walls of the upper respiratory passages which are themselves negatively charged.

This clearly presents a very grave danger to living beings, since it will result in the deposition, actually within the pulmonary tissue and the capillary circulatory system, of mould spores, fungi (mycoses), various bacteria, viruses, irritant and/or carcinogenic chemical substances, and dust of every other kind.

As regards known air-conditioning devices, the air is fed into the space intended for air conditioning with a certain amount of force, but the air so conditioned is in no way ionised, which gives rise to a sensation of heaviness and in addition it is in no way purified, thus keeping the spores, bacteria or other dust mentioned above in permanent circulation.

The negative ioniser which forms the subject of the present invention substantially reduces these various disadvantages since it enables negatively charged ambient air to be produced which is virtually free of any dust or other dangerous items, the said purified and ionised air being furthermore endowed with motion.

German patent specification No. 1,261,295 discloses an ioniser which includes an active filter, an ion absorbing arrangement, and a fan which creates a flow of air endowed with a certain amount of motion.

The ioniser which forms the subject of the present invention adopts the general structure of the ioniser disclosed in the aforementioned German patent specification whilst making a number of improvements to enable a high-performance ioniser to be obtained.

SUMMARY OF THE INVENTION

The ioniser which forms the subject of the present invention and which is of the kind which includes in particular an active filter, a fan or other device intended to set up a forced air-flow, at least one grid which is raised to a high positive potential and is intended to trap harmful negative ions, means for generating negative ions, and at least one grid which is raised to a high negative potential and is intended to trap any positive ions which may be present, is characterised in that the said means for generating negative ions consist of a venturi which is raised to a high negative potential and within which is arranged, coaxially with the said venturi, a tube for generating short-wave ultraviolet radiation, the force-fed air passing through the said venturi.

In a preferred embodiment the said venturi is made of a metal, such as aluminium, which is polished.

BRIEF DESCRIPTION OF THE DRAWING

Other advantages and features will become apparent from the following description taken in conjunction with the single FIGURE of the drawing which is a diagrammatic representation of one embodiment of ioniser according to the invention.

DESCRIPTION OF THE PREFERRED EMBODIMENT

Referring to the FIGURE, the ioniser generally indicated at 1 is of cylindrical shape and has protective grilles 2 and 3 arranged respectively at its inlet and outlet. The function of these grilles is to prevent any foreign bodies from entering the device and to prevent the user from in any way touching the internal parts of the ioniser which are at a high potential.

The polluted air passing through the entry grille 2, first encounters an active filter which is formed by a dry filter 4 of the type which has, for example, a porous cellulose membrane which is intended to trap dust, and also a wet filter 5 which may be impregnated with water or any other bactericidal or deodorising liquid. The ioniser 1 also includes a fan 6 or other similar device which sets up a forced flow of air through the said ioniser.

In addition to the active filter and the fan, the ioniser 1 includes, in the known fashion, at least one grid 7 which is raised to a high positive potential and which is intended to trap the harmful negatively charged particles (viruses or bacteria) which may have penetrated through the active filter, as well as at least one grid 8 which is raised to a high negative potential and which traps any positive ions which may be present and drives the negative ions towards the outside of the ioniser. The air which is negatively ionised in this way is thus discharged from the ioniser by means of the fan and the said grid 8.

The improvements afforded by the present invention reside in the means for generating negative ions. These means are formed by a venturi 9 which is positioned between the grids 7 and 8 and which is raised to a high negative potential, there also being a germicidal tube 10 which generates shortwave ultraviolet radiation arranged within the said venturi coaxially therewith. The wall of the tube 10 may advantageously be made from silica.

The venturi 9 is preferably made of a metal such as aluminium which is polished. The venturi 9 does in fact perform a dual function.

Firstly, under the influence of the ultraviolet radiation, and because of its negative charge, it emits a large quantity of electrons and because of this ionises negatively the air which comes into contact with it.

Secondly, by reason of its configuration, it obliges the air which has been accelerated by fan 6 to pass close to the wall of the tube 10 and because of this to become ionised by the effect of the shortwave ultraviolet radiation. This ionisation is increased still further because of the multiple reflection of the ultraviolet radiation by the reflective wall of the venturi 9 formed of polished aluminium or other metal.

In the preferred embodiment, as illustrated in the accompanying FIGURE, the grid 7 is in fact formed by two staggered grids 7' and 7'', grid 8 being of a similar structure, namely being formed by staggered grids 8' and 8'', the grids 7 and 8 being respectively positioned upstream and downstream of venturi 9 in the direction of forward movement of the air through the ioniser.

As regards the potentials which are employed, excellent results have been obtained with the grid 7 at + 6000 V and the grid 8 at − 6000 V, the venturi 9 being also connected to the potential of − 6000 V, which clearly simplifies the supply of power to the ioniser.

With an ioniser having the structure as described, the following occur in succession. The dust (filter 4) and bacteria (filter 5) are arrested, the negatively charged viruses or bacteria are trapped (grid 7), negative ions are produced (venturi 9 and tube 10), positive ions are trapped and negative ions are expelled (grid 8). The motion of the air is imparted by the fan 6.

An external power source (not shown) produces the high voltage required and the supply for the germicidal tube and the fan.

The high level of the potentials which are employed for the means for generating negative ions enables ozone to be produced. It may be beneficial for ozone to be present in this way since, inter alia, ozone enables any unburnt residue which may be present to be oxidised when the device according to the invention is applied to a motor vehicle or other machine in which combustion takes place, ozone also having the property of displacing carbon monoxide CO from red blood corpuscles, such displacement being particularly important for the well-being of a subject whose corpuscles have already taken up a certain amount of carbon monoxide.

The ioniser of the invention may be used wherever it is advisable to provide a living being with a suitably negatively ionised supply of sterilised air which is free of physical (dust) and/or chemical (noxious gases in particular) contamination, the ions produced by the said ioniser being largely formed by negatively charged oxygen atoms.

It is important to note that oxygen which is not ionised is biologically inactive and consequentially unsuitable for respiration by living beings, hence the usefulness of having available ionised oxygen, which also has a dispersive (anticoagulant) effect on the organised components of blood (red and white blood corpuscles and thrombocytes) and prevents them from adhering to the walls of blood vessels.

This ioniser is thus particularly useful in cases where the locality in which the living being is situated is of small dimensions (aircraft, motor vehicles, etc.) or where the locality in which the said subject is situated requires special conditions (sick rooms), or again where the air which circulates in the locality is used air (as is the case with air-conditioned dwellings or offices).

In this latter case, the ideal solution would appear to be to combine an ordinary air-conditioning system with the ioniser of the present invention.

Generally, the ioniser according to the invention will operate continuously. It is clear however that in certain cases it will be beneficial to cause the said ioniser to operate only periodically.

Thus, according to a modification, the ioniser may be coupled to a timer. In this way, the ioniser will operate at predetermined intervals and the renewal of the air in the locality (and its ionisation) will thus take place at certain predetermined times.

In a second modification, the ioniser according to the invention may be brought into operation by means of an electrical meter or the like, i.e. when the ionisation level in the locality in which the ioniser is situated reaches a lower limit.

By way of brief illustration, a capacitor may be provided which normally discharges for a period $t$, the said period $t$ being a function of the ionisation which prevails at that time. When there are no ions the discharge is slower and this being the case, the capacitor will discharge for a period $t'$. It is easy to provide at this point a system of the electrical meter type which compares period $t'$ to the period $t$, which latter is a function of a pre-established ionisation level; such a system bringing the ioniser into action if for example $t'$ is greater than $t$. In this case the high tension used for the various parts of the ioniser is also used to recharge the capacitor.

It is clear that other possibilities are open to the man skilled in the art without departing from the scope of the present invention.

What is claimed is:

1. In a negative ioniser of the kind which comprises an active filter, means to create a forced flow of air, at least one grid which is raised to a high positive potential and is intended to trap harmful negative ions, means for generating negative ions, and at least one grid which is raised to a high negative potential and is intended to trap any positive ions which may be present, the improvement which consists in that the said means for generating negative ions comprise a venturi which is raised to a high negative potential and which is made of polished metal, and within which, in its narrowest area, is arranged, coaxially with the said venturi, a germicidal tube for generating short-wave ultraviolet radiation.

2. A negative ioniser according to claim 1, wherein the wall of the germicidal tube is made of silica.

3. A negative ioniser according to claim 1, wherein the grid which is raised to a high positive potential and which is positioned upstream of the said venturi, is formed by two staggered metal grids.

4. A negative ioniser according to claim 3, wherein the said two metal grids are raised to a potential of + 6000 V.

5. A negative ioniser according to claim 1, wherein the grid which is raised to a high negative potential and which is positioned downstream of the said venturi, is formed by two staggered metal grids.

6. A negative ioniser according to claim 5, wherein the said two metal grids are connected to the venturi.

* * * * *